US008989638B2

(12) United States Patent
Suzuki

(10) Patent No.: US 8,989,638 B2
(45) Date of Patent: Mar. 24, 2015

(54) DEVELOPER CARRYING DEVICE, DEVELOPMENT DEVICE AND IMAGE FORMING APPARATUS

(71) Applicant: Oki Data Corporation, Tokyo (JP)

(72) Inventor: Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 19 days.

(21) Appl. No.: 13/804,298

(22) Filed: Mar. 14, 2013

(65) Prior Publication Data

US 2013/0259539 A1 Oct. 3, 2013

(30) Foreign Application Priority Data

Mar. 28, 2012 (JP) ..... 2012-074602

(51) Int. Cl.

| | |
|---|---|
| ***G03G 15/06*** | (2006.01) |
| ***G03G 21/00*** | (2006.01) |
| ***G03G 15/08*** | (2006.01) |
| *G03G 21/10* | (2006.01) |

(52) U.S. Cl.

CPC ..... *G03G 21/0005* (2013.01); *G03G 15/0889* (2013.01); *G03G 21/105* (2013.01)

USPC ..... 399/281; 399/119; 399/254

(58) Field of Classification Search

CPC ..... G03G 15/0815; G03G 15/0889; G03G 21/0005; G03G 21/105

USPC ..... 399/119, 120, 252–256, 264, 265, 399/279–281

See application file for complete search history.

(56) References Cited

U.S. PATENT DOCUMENTS

| | | | | |
|---|---|---|---|---|
| 2007/0196135 | A1* | 8/2007 | Fukuta | 399/254 |
| 2009/0087222 | A1* | 4/2009 | Mase et al. | 399/255 |
| 2009/0185833 | A1* | 7/2009 | Shimomura | 399/263 |
| 2011/0158706 | A1* | 6/2011 | Nishiwaki | 399/281 |

FOREIGN PATENT DOCUMENTS

| | | |
|---|---|---|
| JP | 2009-230114 A | 10/2009 |
| JP | 2011-197219 A | 10/2011 |

* cited by examiner

*Primary Examiner* — Walter L Lindsay, Jr.
*Assistant Examiner* — Jessica L Eley
(74) *Attorney, Agent, or Firm* — Muncy, Geissler, Olds & Lowe, P.C.

(57) ABSTRACT

A developer carrying device includes a first developer containing part configured to contain developer, a first rotational member arranged in the first developer containing part, a second developer containing part arranged side by side with the first developer containing part, a second rotational member arranged in the second developer containing part, an opening part formed between the first developer containing part and the second developer containing part, and a restriction part arranged between the first rotational member and the second rotational member.

19 Claims, 9 Drawing Sheets

G11TP0432US01(98B_116)

DEVELOPER CARRYING DEVICE, DEVELOPMENT DEVICE AND IMAGE FORMING APPARATUS

CROSS REFERENCE TO RELATED APPLICATION

The present application is related to, claims priority from and incorporates by reference Japanese Patent Application No. 2012-074602, filed on Mar. 28, 2012.

TECHNICAL FIELD

The present invention relates to an image forming apparatus that uses an electrographic method, such as a printer, a photocopy apparatus and the like, a development device forming a developer image and a developer carrying device that are included in the image forming apparatus.

BACKGROUND

In a conventional development device, a surface of a photosensitive drum evenly charged by a charge device is exposed by an exposure device to form an electrostatic latent image. And then, the electrostatic latent image is developed by the development device to form a toner image as a developer image on the photosensitive drum. After that, the toner image is transferred to a sheet, and is fixed on the sheet. Thereby, an image is formed on the sheet. At this time, in the development device, toner supplied by a toner cartridge is supplied by a supply roller to a development roller. An even toner layer is formed on the development roller with a restriction blade to develop the toner image on the photosensitive drum. During the development, the toner that remains on the development roller is collected with a toner collection roller, and is scraped off the toner collection roller with a toner collection blade (see JP Laid-Open Patent Application No. 2011-197219, columns 0014-0018, FIG. 2, for example).

However, in the conventional art, while the collection toner scraped off the toner collection roller is mixed with new toner supplied from the toner cartridge by an agitation member of the development device, toner that accumulates in the vicinity of the development roller exists. The collection toner is unnecessarily damaged, and a charging characteristic thereof deteriorates in comparison with the new toner. When the collection toner is insufficiently mixed with the new toner, portion having a high proportion of the collection toner occurs. Therefore, there is a problem that detects of the developer image such as fog and blur occur.

An objection of the present invention is to improve image quality of the developer image to solve such a problem.

SUMMARY

Accordingly, a developer carrying device disclosed in the application includes a first developer containing part configured to contain developer, a first rotational member arranged in the first developer containing part, a second developer containing part arranged side by side with the first developer containing part, a second rotational member arranged in the second developer containing part, an opening part formed between the first developer containing part and the second developer containing part, and a restriction part arranged between the first rotational member and the second rotational member.

According to the present invention, an effect that the image quality of the developer image is improved is obtained.

DESCRIPTION OF EMBODIMENTS

Embodiments of a developer carrying device, a development device and an image forming apparatus according to the present invention are explained below with reference to the drawings.

First Embodiment

Figure 2:
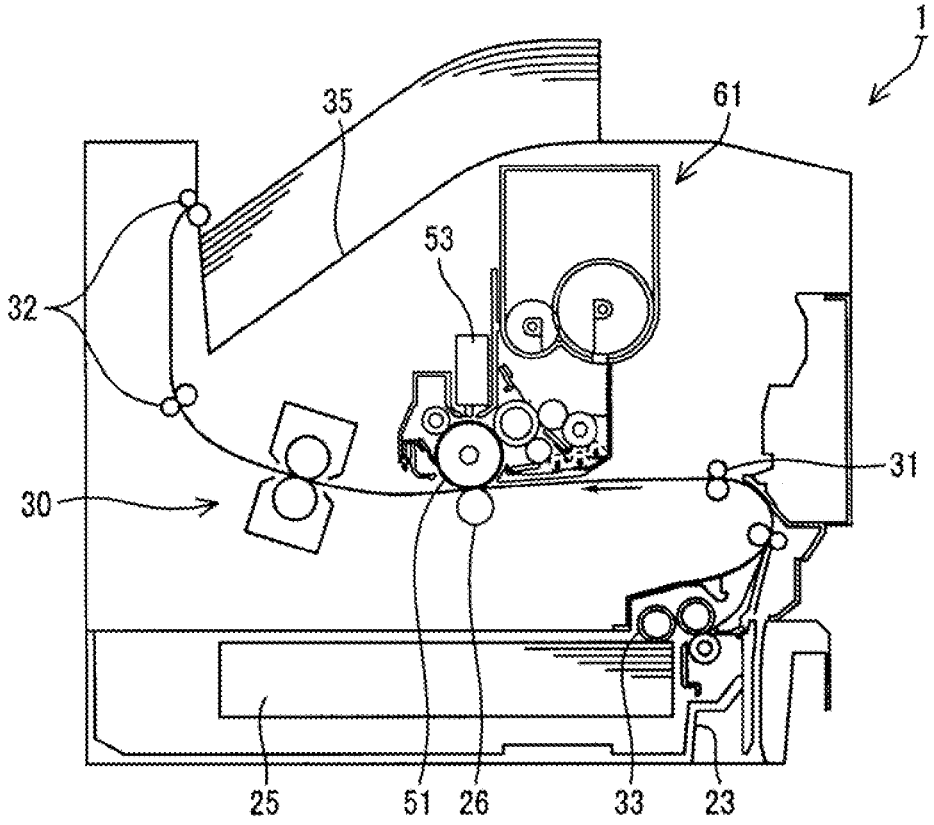
FIG. 2 is a schematic side diagram of a configuration of a printer according to a first embodiment.

FIG. 2 is a schematic side diagram of a configuration of a printer according to a first embodiment.

In FIG. 2, an image forming apparatus 1 is a monochrome printer that includes a development unit 61 as a development device and uses an electrographic method. A sheet feeding tray 23 is installed to the image forming apparatus 1. The sheet feeding tray 23 accommodates recording sheets 25 as recording mediums therein. A hopping roller 33 and registration rollers 31 are arranged in the image forming apparatus 1. The hopping roller 33 feeds the recording sheet 25 from the sheet feeding tray 23. The registration rollers 31 corrects skew of the fed recording sheet 25, and carries to a later-discussed image forming part.

In addition, the development unit 61 as an image forming part is arranged in the image forming apparatus 1. The development unit 61 forms an image made of toner as developer. An LED (Light Emitting Diode) head 53 and a transfer roller 26 are arranged in the image forming apparatus 1. The LED head 53 is adjacent to the development unit 61, and selectively irradiates the surface of a photosensitive drum 51 in the development unit with light based on image data to form an electrostatic latent image on the surface of the photosensitive drum 51. The transfer roller 26 is adjacent to the photosensitive drum 51, and transfers a toner image formed on the photosensitive drum 51 onto the recording sheet 25. The fed recording sheet 25 is carried in a direction indicated by an arrow in FIG. 2.

Furthermore, a fuser device 30 and ejection rollers 32 are arranged in the image forming apparatus 1. The fuser device 30 fixes the toner image, which has been transferred by the transfer roller 26 and formed on the recording sheet 25, on the recording sheet 25 by applying heat and pressure. The recording sheet 25 on which the toner image has been fixed passes the fuser device 30. The ejection rollers 32 carry and eject the recording sheet 25 on a stacker 35 on which the recording sheets 25 pile.

Figure 1:
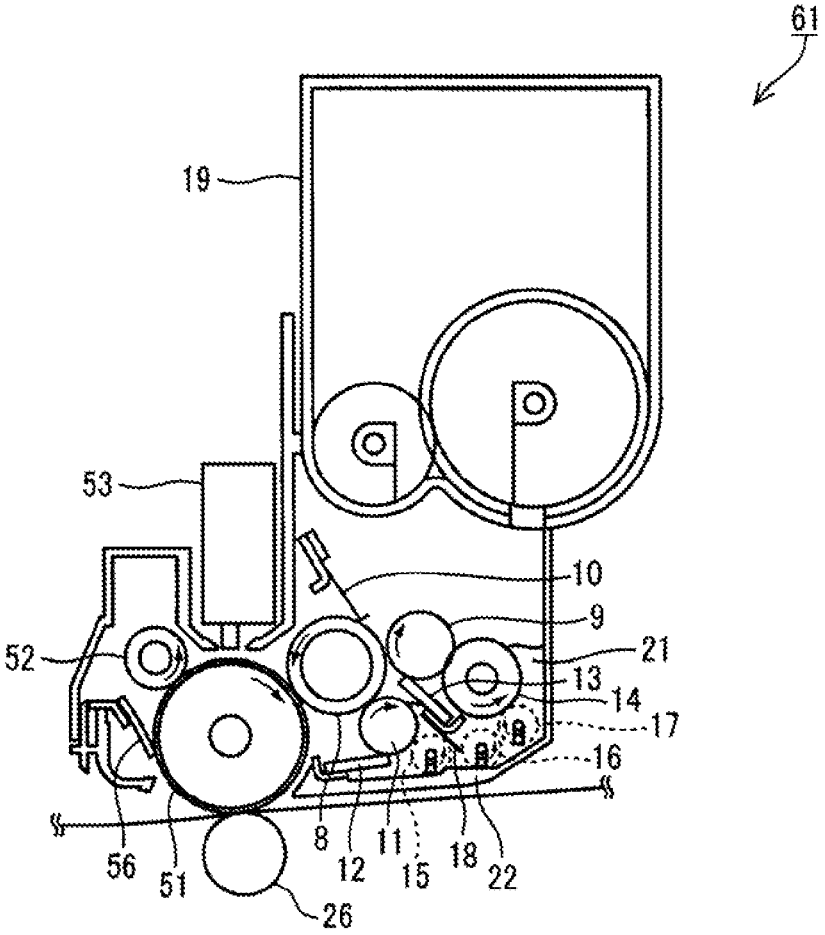
FIG. 1 is a schematic side diagram of a configuration of a development device according to a first embodiment.
Figure 3A:
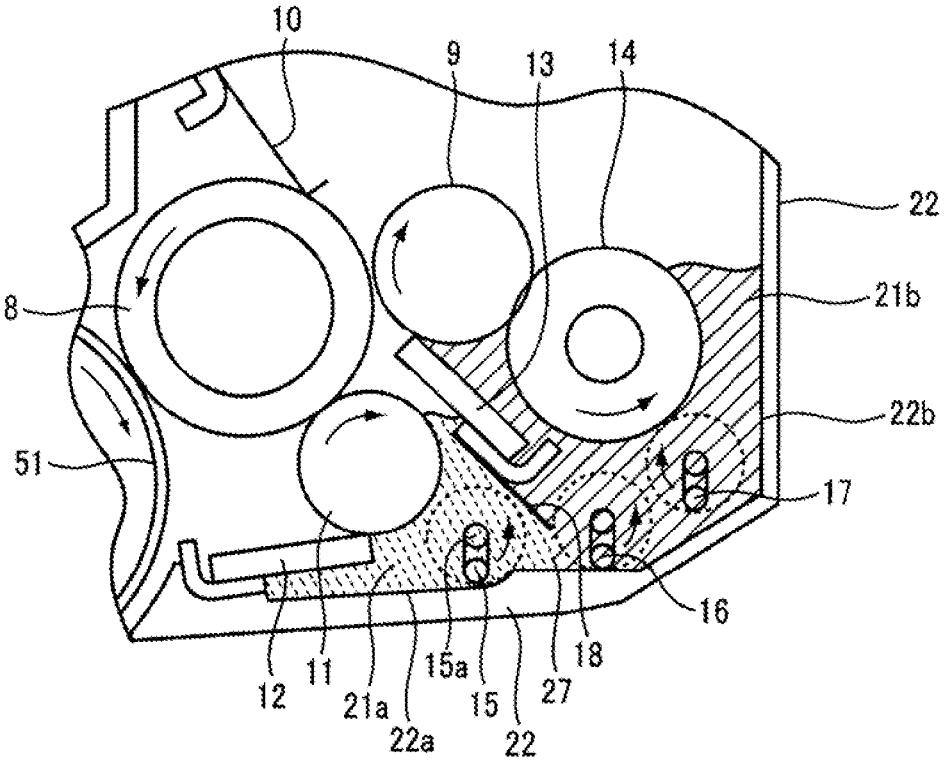
FIG. 3A is an enlarged diagram of a main part of the configuration of the development device according to the first embodiment.
Figure 3B:
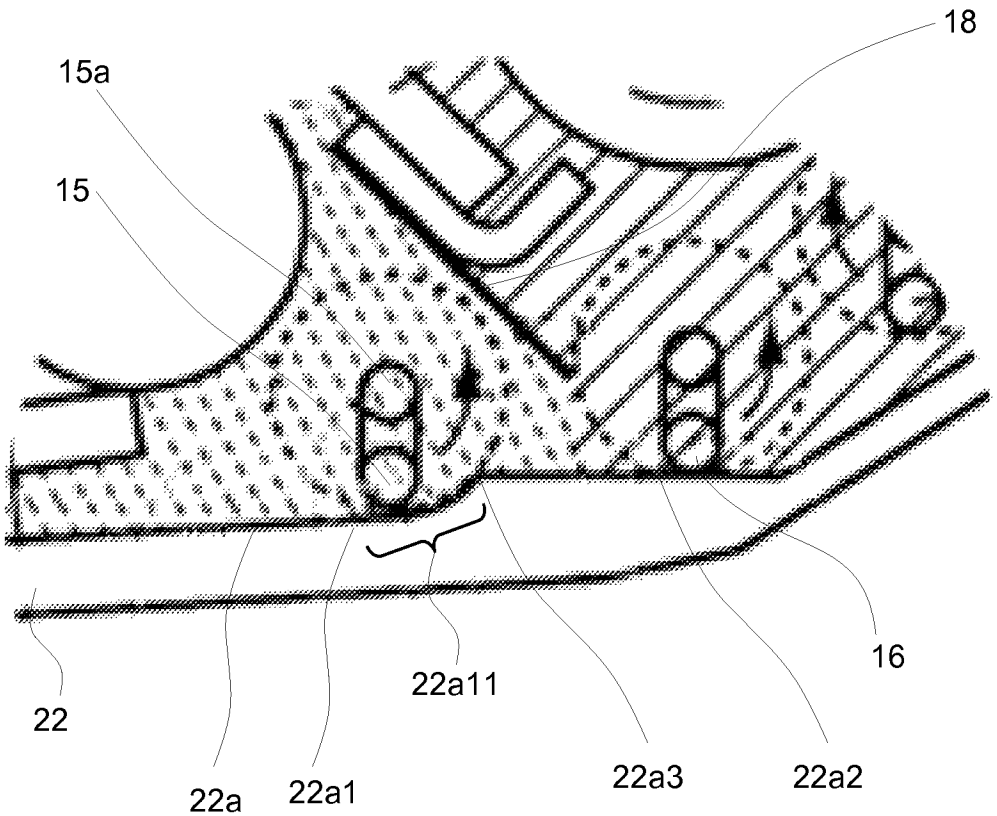
FIG. 3B is a further enlarged diagram around agitation bar 15.

FIG. 1 is a schematic side diagram of a configuration of the development device according to the first embodiment. FIG. 3A is an enlarged diagram of a main part of the configuration of the development device according to the first embodiment. FIG. 3B is a further enlarged diagram around agitation bar 15.

In FIGS. 1 and 3, the development unit 61 includes a development roller 8 as a developer carrier, a supply roller 9 as a developer supply member and a collection roller 11 as a developer collection member, and is a development device that carries the developer collected by the collection roller 11 to the development roller 8 side. The development roller 8 supplies the toner on the photosensitive drum 51 as an image carrier. The photosensitive drum 51 carries the toner image as a developer image. The supply roller 9 supplies the toner on the development roller 8. The collection roller 11 collects the toner from the development roller 8.

To discuss in detail, the development unit 61 is configured by the photosensitive drum 51 as the image carrier, a charging roller 52, the development roller 8 as the developer carrier, the supply roller 9 as the developer supply member, a subsidiary supply roller 14, a first restriction blade 13, a second restriction blade 10, the collection roller 11 as the developer collection member, a collection blade 12 as a developer removal member, an agitation bar 15 as a first rotational member, an agitation bar 16 as a second rotational member, a backflow prevention member 18 as a restriction part, a toner containing part 21 as a developer storage part, a toner cartridge 19 and a agitation bar 17. The charging roller 52 supplies electric charges on the surface of the photosensitive drum 51 to charge the surface of the photosensitive drum 51. The development roller 8 is arranged to contact the surface of the photosensitive drum 51. The supply roller 9 is arranged to keep a slight space between the supply roller 9 and the development roller 8. The subsidiary supply roller 14 attaches the toner to the supply roller 9. The first restriction blade 13 is arranged so that a front edge part thereof abuts on the supply roller 9. The second restriction blade 10 is arranged so that a front edge part thereof abuts on the development roller 8. The collection roller 11 is arranged to contact the development roller 8. A front edge of the collection blade 12 abuts on the collection roller 11, and the collection blade 12 scrapes the collection toner attached to the surface of the collection roller 11. The agitation bar 15 faces the collection roller 11 in the vicinity of the collection roller 11, and is arranged between the collection blade 12 and the subsidiary supply roller 14. The agitation bar 16 is arranged in the vicinity of the subsidiary supply roller 14 and at a position in which the agitation bar 16 faces the agitation bar 15. The backflow prevention member 18 is arranged between the agitation bar 15 and the agitation bar 16, and inhibits backflow of the toner in a direction from the agitation bar 16 side to the agitation bar 15. The toner cartridge 19 is arranged above the subsidiary supply roller 14, and refills new toner. The agitation bar 17 is provided between the subsidiary supply roller 14 and the agitation bar 16.

The agitation bar 15 as the first rotational member is arranged between the collection roller 11 as the developer collection member and the supply roller 9 as the developer supply member. The agitation bar 16 as the second rotational member is arranged between the agitation bar 15 and the supply roller 9. The backflow prevention member 18 as the restriction part is arranged between the agitation bar 15 and the agitation bar 16.

The agitation bar 15 carries the toner collected by the collection roller 11 to the agitation bar 16 side by rotating. The agitation bar 16 carries the toner carried by the collection roller 15 to the supply roller 9 side by rotating. The backflow prevention member 18 is arranged between the first toner containing part 21*a* (first developer containing part) and a second toner containing part 21*b* (second developer containing part). The first toner containing part 21*a* contains the toner collected by the collection roller 11. The second toner containing part 21*b* contains the toner carried from the first toner containing part 21*a* by the agitation bar 15. The backflow prevention member 18 prevents the toner contained in the second toner containing part 21*b* from flowing into the first toner containing part 21*a*.

The first toner containing part 21*a* that retains the collection toner is formed of an outer circumference of the collection roller 11, an outer circumference of the collection blade 12, a bottom surface 22*a* of a frame 22 of the development unit 61, an outer circumference of the backflow prevention member 18 and an outer circumference of the first restriction blade 13 as illustrated by the dotted hatch part in FIG. 3A.

In addition, the second toner containing part 21*b* that retains unused toner (new toner) and the collection toner carried from the first toner containing part 21*a* is formed of an outer circumference of the subsidiary supply roller 14, an outer circumference of the supply roller 9, an outer circumference of the first restriction blade 13, an outer circumference of the backflow prevention member 18, and the bottom surface 22*a* of the frame 22 of the development unit 61 and a side surface 22*b* as illustrated by the solid hatch part in FIG. 3A.

The first toner containing part 21*a* communicate with the second toner containing part 21*b* through an opening part 27 formed between the bottom surface 22*a* of the frame 22 of the development unit 61 and the backflow prevention member 18. The toner is sent and received through the opening part 27.

The agitation bar 15 is arranged in a region of the first toner containing part 21*a*. The agitation bar 16 is arranged in a region of the second toner containing part 21*b*. The agitation bar 15 and the agitation bar 16 rotate in directions indicated by the respective arrows in FIGS. 1 and 3, carry the collection toner retained in the first toner containing part 21*a* to the second toner containing part 21*b* in order to prevent the collection toner collected by the collection roller 11 from accumulating in the vicinity of the development roller 8.

Furthermore, the development unit 61 includes a photosensitive body cleaning device 56. The photosensitive body cleaning device 56 scrapes and disposes the toner that has not been transferred and remains on the photosensitive drum 51.

A developer carrying device is configured by the first toner containing part 21*a*, the agitation bar 15, the second toner containing part 21*b*, the agitation bar 16, the opening part 27 and the backflow prevention member 18.

The bottom surface 22*a* that is a part of frame 22 has a first surface 22*a*1, which faces the agitation bar 15, and a second surface 22*a*2, which faces the agitation bar 16. Herein, the two surfaces 22*a*1 and 22*a*2 are not arranged on a single plane, but arranged with a gap. Thereby, there is a ridge line 22*a*3 therebetween. A region 22*a*11 of the first surface 22*a*1 in the vicinity of the ridge line 22*a*3 is formed along the outer surface of the agitation bar 15.

The photosensitive drum 51 is rotatably driven in a direction indicated by an arrow in FIGS. 1 and 3 by a drum drive gear (not illustrated). The drum drive gear is rotatably driven by a drive motor (not illustrated). The charging roller 52 is rotatably driven in a direction indicated by an arrow in FIG. 1 by a driving power transmitted by friction between the charging roller 52 and the surface of the photosensitive drum 51. The development roller 8 is rotatably driven in a direction indicated by an arrow in FIGS. 1 and 3 by a driving power transmitted through gears from the photosensitive drum 51. The supply roller 9 is rotatably driven in a direction indicated by an arrow in FIGS. 1 and 3 by a driving power transmitted through an idler gear from the development roller 8. The subsidiary supply roller 14 is rotatably driven in a direction indicated by an arrow in FIGS. 1 and 3 by a driving power transmitted through gears from the photosensitive supply roller 9. The collection roller 11 is rotatably driven in a direction indicated by an arrow in FIGS. 1 and 3 by a driving power transmitted through an idler gear from the supply roller 9.

Rotation shafts of the agitation bar 15, the agitation bar 16 and the agitation bar 17 are arranged in parallel to each other. The agitation bar 15 and the agitation bar 16 are rotatably driven in a direction indicated by an arrow in FIGS. 1 and 3 by a driving power transmitted through idler gears from the collection roller 11, for example. The agitation bar 17 is rotatably driven in a direction indicated by an arrow in FIGS. 1 and 3 by a driving power transmitted through gears from the subsidiary supply roller 14.

Here, the rotational directions of the agitation bar 15 and the agitation bar 16 are the opposite direction from the rotational direction of the collection roller 11. However, the directions are not limited to the opposite direction, but may be the same direction as the rotational direction of the collection roller 11 in the present embodiment. Note that it is necessary that the rotational directions of the agitation bar 15 and the agitation bar 16 are the same direction from each other to smoothly carry the toner.

In addition, the development roller 8 is rotated in a direction with the rotation of the rotation of the photosensitive drum 51 at a circumferential speed ratio of 1.21 times relative to the photosensitive drum 51. The toner supplying roller 9 is rotated in a direction with the rotation of the rotation of the development roller 8 at a circumferential speed ratio of 1.25 times relative to the development roller 8. The subsidiary supply roller 14 is rotated in a direction with the rotation of the rotation of the supply roller 9 at a circumferential speed ratio of 0.92 times relative to the supply roller 9. The collection roller 11 is rotated in a direction with the rotation of the rotation of the development roller 8 at a circumferential speed ratio of 0.98 times relative to the development roller 8. Note that the circumferential speed ratios are not limited those described above.

Figure 4:
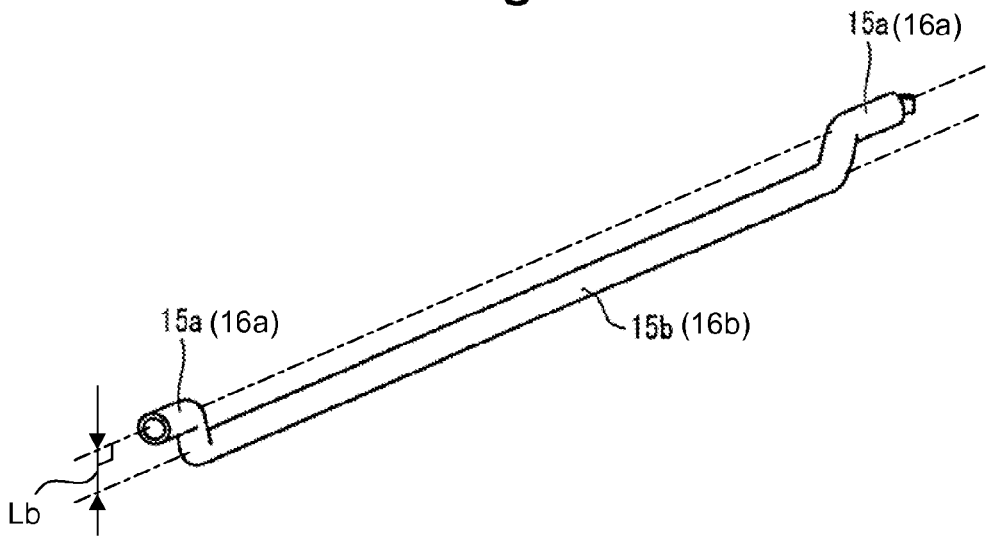
FIG. 4 is a perspective view of an agitation bar according to the first embodiment.

Next, materials and configurations of respective parts are explained below with reference to FIGS. 1, 4 and 5.

The toner used in the present embodiment is made as follows: toner particles are produced by an emulsion polymerization method; styrene-acrylic copolymer resin, colorant and wax are mixed; such a mixture is aggregated to produce the toner particles; and silica, titanium oxide fine particles are added to the toner particles and mixed by a mixer, for example. The toner is formed to have an average particle size of 6 μm, for example. The emulsion polymerization method represents a method for producing a toner particle as follows: a primary particle of a polymer as blinding resin for the toner is produced in water solvent; colorant emulsified by emulsifying agent (surface active agent) is mixed with the solvent used for primary particle production; wax, charge control agent, and the like are mixed as may be needed; and such a mixture is aggregated to produce the toner particles in the solvent. The toner particles are removed from the solvent, washed and dried, so that an unnecessary solvent component and a by-product component are removed from the toner particle.

Here, the styrene-acrylic copolymer resin is generated from styrene, acrylic acid, and methylmethacrylate. The colorant includes the carbon black used as black, pigment yellow 74 used as yellow, pigment red 238 used as magenta and pigment blue 15:3 used as cyan. Furthermore, the wax includes stearyl stearate used as high-class fatty acid ester wax.

The photosensitive drum 51 is formed of an electric charge generation layer having a film thickness of 0.5 μm and an electric charge transportation layer having a film thickness of 18 μm provided on an aluminum tube having a thickness of 0.75 mm and an outside diameter of 30 mm, for example. The electric charge generation layer is preferably formed of an electric charge generation material made of selenium, selenium alloy, a selenium arsenic compound, cadmium sulfide, zinc oxide, other inorganic photoconductive material, or various organic pigment/dye such as phthalocyanine, azo color, quinacridon, polycyclic quinone, pyrylium salt, thiapyrylium salt, indigo, thioindigo, anthanthrone, pyranthrone, and cyanine, for example.

In addition, the electric charge transportation layer is preferably formed of an electric charge transportation material made of aniline derivative, a hydrazone compound, aromatic amino-derivative, stilbene derivative, or a heterocyclic compound such as carbazol, indole, imidazole, oxazole, pyrazole, pyrazoline, thiadiazole and the like, or an electron-donating material such as a polymer including a group made by combination of such substances or materials in a main chain or a side chain, for example.

The charging roller 52 is a device that uniformly charges the surface of the photosensitive drum 51. The charging roller 52 is formed of a conductive member as a shaft made of stainless steel and the like and a conductive elastic layer made of epichlorohydrin and the like, for example. The charging roller 52 is arranged in contact with an outer circumferential surface of the photosensitive drum 51.

The LED head 53 is an exposure device that selectively exposes the uniformly charged surface of the photosensitive drum 51 to light thereof to form an electrostatic latent image pattern on the surface of the photosensitive drum 51. The LED head 53 is configured from LED elements, LED drive elements, and a lens array. The LED head 3 is arranged at a position in which the light radiated by the LED elements forms an image on the surface of the photosensitive drum 51.

The development roller 8 is configured by a conductive shaft (core) made of, for example, a steel use machinerbility (SUM) material, an elastic layer provided on the conductive shaft in such a manner as to be in a roll shape, and a surface layer covering the elastic layer. The development roller 8 is arranged to contact the outer circumferential surface of the photosensitive drum 51. The elastic layer is made of urethane rubber or silicone rubber. The surface layer is formed by processing a surface of the elastic layer with urethane solution, or by applying acrylic resin, acrylic-fluoro copolymer resin on the surface of the elastic layer. When the surface layer is formed of the acrylic resin, acrylic-fluoro copolymer resin, carbon black is blended in the acrylic resin to impart the conductivity to the surface layer. Herein, one part by weight of the carbon black is blended to one hundred parts by weight of the acrylic resin.

The supply roller 9 is a round bar or a pipe made of aluminum or stainless steel, for example. Surface roughness Ra of the surface of the supply roller 9 is adjusted to be Ra=1.6 or less by blast process or polish process. The subsidiary supply roller 14 is formed of a conductive shaft (core) made of, for example, a SUM material, and an elastic layer. The supply roller 9 is arranged to contact the outer circumferential surface of the supply roller 9. The elastic layer is a conductive silicone rubber foam layer or a conductive urethane rubber foam layer. When an elastic layer having a semi-conductive property is used, acetylene black and carbon black are added, for example.

The first restriction blade 13 is configured by a conductive rubber blade or a conductive resin film. The first restriction blade 13 is arranged so that a front edge of the blade abuts on the surface of the supply roller 9 in a trail direction. The second restriction blade 10 is formed of a SUS material having a thickness of 0.08 mm, for example. The second restriction blade 10 includes a contact part that contacts the development roller 8, and the contact part undergoes a bending process to form a curvature part having a curvature radius R of 0.2 mm. The second restriction blade 10 has a linear pressure of 30 gf/cm to the development roller 8. Note that the curvature radius R and the linear pressure of the restriction blade 10 are not limited to the values described above, but is adjustable according to the charge amount of the toner.

The collection roller 11 is made of a conductive body that is formed by nickel plating on a SUM material, for example. The collection roller 11 is arranged to contact the outer circumferential surface of the development roller 8. When the collection roller 11 is made of metal, a load to the development roller 8 is minimized. In addition, a degree of smoothness of the surface of the collection roller 11 increases to reduce a friction coefficient of the surface of the collection roller 11. Thereby, the toner is easily scraped off when the toner attached to the surface of the collection roller 11 is scraped off with the collection blade 12. The collection roller 11 is configured by metal in the present embodiment. However, the collection roller 11 is not limited to metal, but is also configured by a member having a conductive property, a high degree of smoothness and an excellent durability.

The collection blade 12 is configured by, for example, a rubber blade. The collection blade 12 is arranged so that a front edge of the rubber blade abuts on the surface of the collection roller 11 in a counter (opposite) direction from the rotational direction of the collection roller 11.

The agitation bar 15, agitation bar 16 and agitation bar 17 are configured to be a rod-shaped member that is a stainless shaft bended in a crank shape. For example, as illustrated in FIG. 4, a crank part 15*b* rotates around a rotation center 15*a* in the agitation bar 15. The agitation bar 15 agitates and carries the toner. In addition, the agitation bar 16 has a same shape as the agitation bar 15, rotates, agitates and carries the toner in the same manner as the agitation bar 15. As shown in FIG. 4, the rotation centers 15*a* and 16*a*, which are positioned at the both ends, are arranged on an axis. The crank parts 15*b* and 16*b* are arranged at a place that is offset with a gap Lb from the axis. The degree of offset can be set flexibly considering features of materials, scale of the device etc. For a general sized MPF, the gap is preferably within 0.05 mm to 2.0 mm.

The backflow prevention member 18 is formed of a film member, for example, a polyester film having a thickness of 0.2 mm, which extends in a direction parallel to the rotation shafts of the agitation bar 15, the agitation bar 16 and the agitation bar 17. As illustrated in FIG. 5, one end as a fixed end 18*b* of the backflow prevention member 18 is affixed on a holder of the first restriction blade 13 on the opposite side from a bottom surface 22*a* (one surface of the first toner containing part 21*a*) with a double-faced tape and the like. The other end (free end 18*a*) of the backflow prevention member 18 is arranged in the vicinity of a line L1 that links the rotation shaft 15*a* of the agitation bar 15 to the rotation shaft 16*a* of the agitation bar 16. The free end 18*a* is in contact with the line L1, or is arranged to extend to a position in which the free end 18*a* protrudes into the line L1. The imaginary line L1 is defined as an imaginary linkage line. Accordingly, an opening part 27 is formed between the free end 18*a* and the bottom surface 22*a* of the first toner containing part 21*a*. Toner carried in a direction indicated by an arrow A in FIG. 5 by the agitation bar 15 passes through the opening part 27. Further, the backflow prevention member 18 is arranged at a position, in a rotation region of the agitation bar 16, that faces a region S18 with respect to a toner carrying direction (or arrow A direction). The region S18 is defined by a rotation area from the second toner containing part 21*b* toward the first toner containing part 21*a*. The opening part 27 is arranged at another position, in a rotation region of the agitation bar 15, that faces a region S27 with respect to the toner carrying direction (or arrow A direction). The side S27 is defined by a rotation area from the first toner containing part 21*a* toward the second toner containing part 21*b*. The regions S18 and 27 are illustrated in FIG. 5.

In order not to interrupt the agitation bar 15 when the agitation bar 15 presses the toner in the direction of the agitation bar 16, the free end 18*a* of the backflow prevention member 18 is attached to the agitation bar 16 side while the fixed end 18*b* of the backflow prevention member 18 is attached to the agitation bar 15 side. The backflow prevention member 18 inclines with respect to the line L1 that links the rotation shaft 15*a* of the agitation bar 15 to the rotation shaft 16*a* of the agitation bar 16. There is an acute angle $\alpha$ between the backflow prevention member 18 (film) and the line L1.

In order to prevent the backflow of the toner in a direction from the agitation bar 16 to the agitation bar 15, the free end 18*a* (front edge) of the backflow prevention member 18 needs to extend from a tangential line L2 that links a rotational outer circumference of the agitation bar 15 and a rotational outer circumference of the agitation bar 16 to the line L1 side that links the rotation shaft 15*a* of the agitation bar 15 to the rotation shaft 16*a* of the agitation bar 16.

Figure 5:
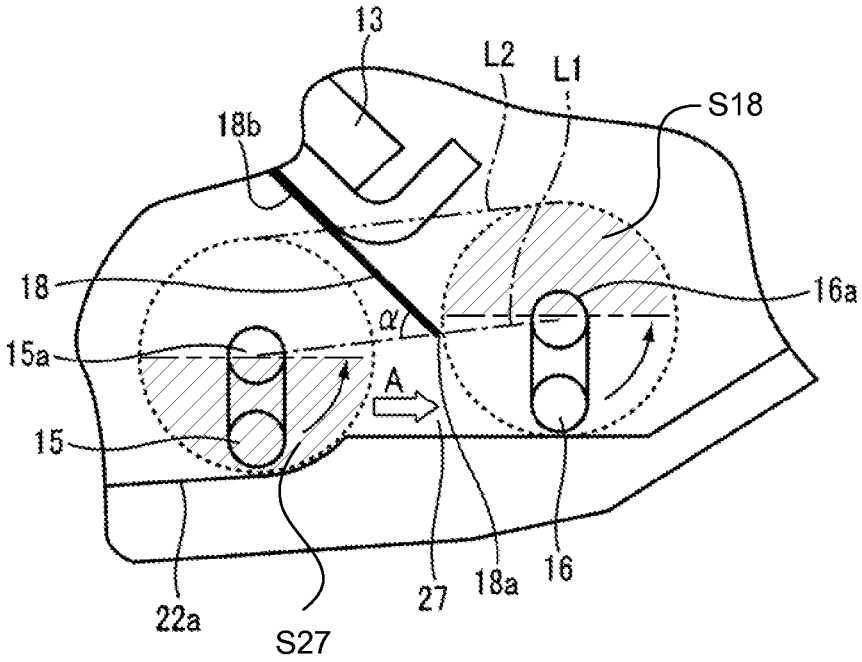
FIG. 5 is explanatory diagrams illustrating the agitation bar and a backflow prevention member according to the first embodiment.

As illustrated in FIG. 5, the agitation bar 16 is provided in a downstream side of the agitation bar 15 in the direction indicated by the arrow A in FIG. 5 in which the toner is carried. The backflow prevention member 18 as the restriction part is provided between the agitation bar 15 and the agitation bar 16. The backflow prevention member 18 is arranged a position in which the backflow prevention member 18 restricts the carriage of the toner due to an operation in an opposite direction from the direction in which the agitation bar 16 carries the toner. The agitation bars 15, 16 are provided in a downstream side in the direction in which the collection roller 11 carries the toner in the present embodiment.

In addition, the agitation bar 15 rotates in the same direction (counterclockwise direction) as the agitation bar 16. The backflow prevention member 18 is formed to extend from the vicinity of the line L1 that links the rotation shaft 15*a* of the agitation bar 15 to the rotation shaft 16*a* of the agitation bar 16 to the outer tangential line L2 on the opposite side from the bottom surface 22*a*. The bottom surface 22*a* restricts the carriage of the toner to the opposite side from the direction in which the toner is carried by the agitation bar 16. Thereby, the toner is carried in the direction indicated by the arrow A in FIG. 5 from the first toner containing part 21*a* to the second toner containing part 21*b*.

The backflow prevention member 18 is formed of a film member, and the one end of the backflow prevention member 18 is the free end 18*a*. Thereby, the backflow prevention member 18 oscillates. Accordingly, there is an effect that the aggregation of the toner in the vicinity of the backflow prevention member 18 reduces.

The quality of material and the thickness of the backflow prevention member 18 are not limited to those of a film, but may be those of a metal plate, a resin molded article and the like.

The transfer roller 26 is, for example, formed of a conductive shaft and a foam elastic member having a conductive property. The photosensitive body cleaning device 56 is configured by, for example, a rubber blade, and is arranged so that a front edge of the rubber blade abuts on the surface of the photosensitive drum 51.

A function of the configurations discussed above is explained with reference to FIGS. 1 to 3.

The surface of the photosensitive drum 51 of the development unit 61 is uniformly charged by the charging roller 52 to which the charge voltage is applied by a power source device (not illustrated). The LED head 53 emits light in accordance with image data, and selectively exposes the uniformly charged surface of the photosensitive drum 51 to the light thereof, thereby forming the electrostatic latent image on the surface of the photosensitive drum 51. In the meantime, the subsidiary supply roller 14 rotates while the subsidiary supply roller 14 scoops up and carries the toner on the sponge surface thereof and in cell openings thereon. The subsidiary supply roller 14 arrives at an abutting part at which the subsidiary supply roller 14 abuts on the supply roller 9. A direct current bias voltage of −300V, an alternating current bias voltage at 600V peak-to-peak and a rectangle wave frequency of 2 kHz are applied to the supply roller 9.

Accordingly, alternating current bias voltage within the range of 0V through −600V is applied to the supply roller 9. A bias voltage of −1 kV through −4 kV is applied to the subsidiary supply roller 14 so that a current of approximately 10 μA flows from the supply roller 9 to the subsidiary supply roller 14. Therefore, negative electric charges passes the toner between the subsidiary supply roller 14 and the supply roller 9, and moves at the abutting part from the subsidiary supply roller 14 to the supply roller 9. At this time, the toner is charged and attached to the surface of the supply roller 9 by image a function and an image force of an electric field between the subsidiary supply roller 14 and the supply roller 9.

The toner attached to the supply roller 9 is charged and thinned by the first restriction blade 13 to which the same bias voltage as the supply roller 9 is applied. The thinned toner on the supply roller 9 arrives at a facing part at which the supply roller 9 faces the development roller 8 by the rotation of the supply roller 9. A direct current bias voltage of −200V is applied to the development roller 8 and a development blade 10. Accordingly, since an electric field of +200V through −400V is formed as an oscillating electric field between the supply roller 9 and the development roller 8, the toner on the surface of the supply roller 9 soars in a direction of the development roller 8 and is carried on the surface of the development roller 8. After the toner is thinned by the development blade 10, the toner corresponds to the electrostatic latent image formed on the photosensitive drum 51 and is developed.

In the meantime, the recording sheet 25 accommodated in the sheet feeding tray 23 is picked up from the sheet feeding tray 23 by the hopping roller 33. After the skew of the recording sheet 25 is corrected by the registration rollers 31, the recording sheet 25, and is carried to the vicinity of the transfer roller 26. And then, when the toner image on the surface of the photosensitive drum 51 obtained by the development reaches the vicinity of the transfer roller 26 by the rotation of the photosensitive drum 51, the toner image on the surface of the photosensitive drum 51 is transferred onto the recording sheet 25 by the transfer roller 26 to which a voltage is applied by the power source device (not illustrated).

Next, the recording sheet 25 including the toner image formed on the surface thereof is carried to the fuser device 30 by the rotation of the transfer roller 26. The toner image on the recording sheet 25 is fused and fixed on the recording sheet 25 when the fuser device 30 applies a pressure to and heat the recording sheet 25. Furthermore, the recording sheet 25 is ejected on the stacker 35 by the carrying rollers 32. The operation of the image formation performed by the image forming apparatus 1 is completed.

In a step of the image formation described above, in order to collect the development residual toner that has remained on the surface of the development roller 8 without moving to the photosensitive drum 51 during the development, the collection roller 11 is connected to ground through the resistance so that a collection voltage whose polarity is opposite to the charge polarity of the toner is applied to the collection roller 11. The development residual toner moves onto the collection roller 11. Furthermore, the development residual toner is scraped off the collection roller 11 by the collection blade 12. The residual toner scraped off the collection roller 11 is agitated by the rotation operation of the agitation bar 15. One part of the toner passes below the backflow prevention member 18 and moves to the agitation bar 16 side. While the toner that has moved to the agitation bar 16 side is agitated by the rotation operation of the agitation bar 16, one part of the toner moves into the second toner containing part 21*b*, is mixed into toner in the second toner containing part 21*b* by the agitation bar 17, is attached to the subsidiary supply roller 14 again, and moves to the supply roller 9 and the development roller 8.

At this time, the toner is sent and received between the agitation bar 15 and the agitation bar 16. The flow of the toner that moves from the agitation bar 16 to the agitation bar 15 side is restricted by the backflow prevention member 18. Furthermore, as the toner collected from the development roller 8 gradually increases, a pressure of the toner in the first toner containing part 21*a* increases. Therefore, a movement amount Ta of the toner that moves in the direction from the agitation bar 15 to the agitation bar 16 is more than a movement amount Tb of the toner that moves in the direction from the agitation bar 16 to the agitation bar 15 with the rotation of the agitation bar 16. The relationship between the movement amount Ta and the movement amount Tb is expressed as follows:

(Movement amount Ta of the toner)>(Movement amount Tb of the toner)

Therefore, a cycle, in which the collected toner is mixed into the toner in the second toner containing part 21*b* and is reused, is realized.

As described above, the toner collected by the collection roller 11 moves from the agitation bar 15 to the agitation bar 16 side by the rotation of the agitation bar 15 and the agitation bar 16 as well as the function of the backflow prevention member 18. The collected toner does not accumulate in the vicinity of the development roller 8. Thereby, defects of the developer image such as fog and blur are prevented. Accordingly, the quality of the image of the developer image is improved. In addition, the collected toner is efficiently reused.

As explained above, in the first embodiment, the agitation bars that rotate and the backflow prevention member that restricts the backflow of the toner are provided. The toner collected by the collection roller moves from the first toner containing part that retains the collection toner to the second toner containing part side that retains unused toner. The collected toner does not accumulate in the vicinity of the development roller. Accordingly, an effect that the quality of the image of the developer image is improved is obtained.

In addition, an effect that the collected toner is efficiently reused is obtained.

Second Embodiment

Figure 6:
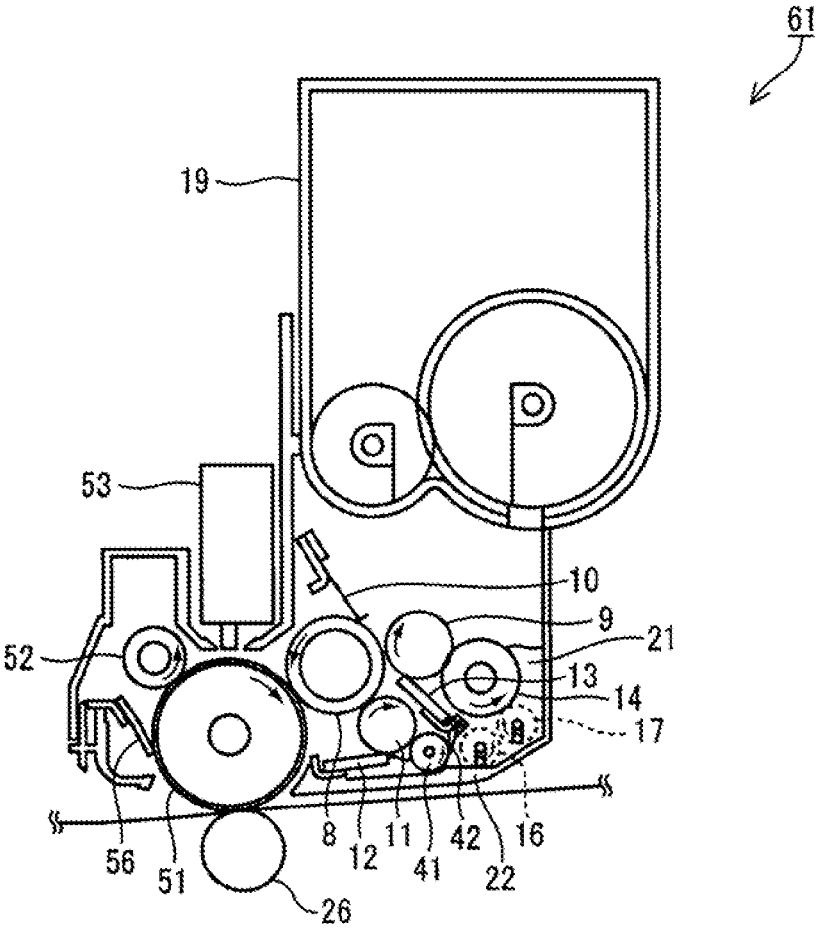
FIG. 6 is a schematic side diagram of a configuration of a development device according to a second embodiment.
Figure 7A:
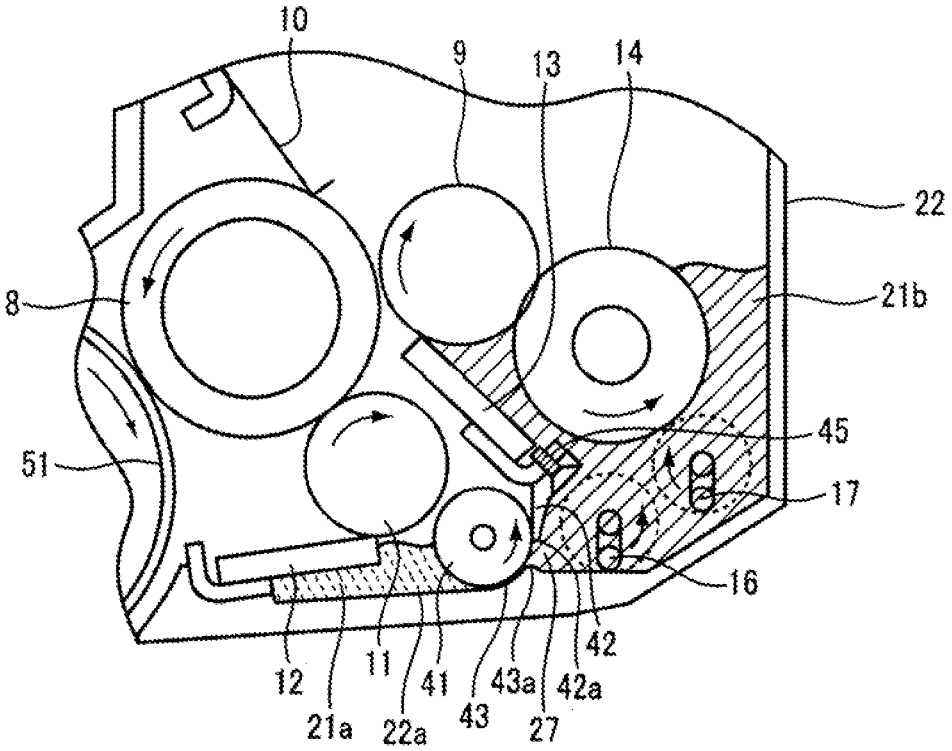
FIG. 7A is an enlarged diagram of a main part of a configuration of the development device according to the second embodiment.
Figure 7B:
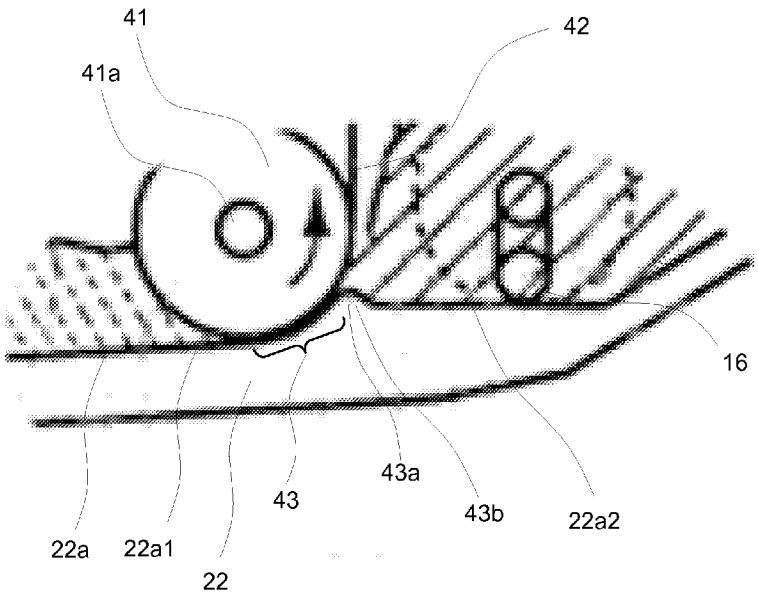
FIG. 7B is a further enlarged diagram around carrying roller 41.

FIG. 6 is a schematic side diagram of a configuration of a development device according to a second embodiment. FIG. 7A is an enlarged diagram of a main part of a configuration of the development device according to the second embodiment. FIG. 7B is a further enlarged diagram around carrying roller 41 Duplicative explanations on parts that are the same as the first embodiment discussed are omitted, and elements that are the same as or corresponding to the first embodiment are indicated with the same symbols.

In FIGS. 6, 7A and 7B, a carrying roller 41 (roller member) as a first rotational member faces the collection roller 11 in the vicinity of the collection roller 11, and is arranged between the collection blade 12 and the subsidiary supply roller 14. The carrying roller 41 is configured by a conductive shaft (core) made of, for example, a steel use machinerbility (SUM) material and a silicone rubber foam layer or a urethane rubber foam elastic layer formed on the shaft in such a manner as to be in a roll shape. The carrying roller 41 rotates in a direction indicated by an arrow in FIGS. 6 and 7 by a driving power transmitted through an idler gear (not illustrated) from the collection roller 11.

In addition, a backflow prevention member 42 as a restriction part is arranged between the carrying roller 41 and the agitation bar 16 on the subsidiary supply roller 14 side of the carrying roller 41. The backflow prevention member 42 inhibits the backflow of the toner in a direction from the agitation bar 16 side to the carrying roller 41.

The backflow prevention member 42 is a blade shaped, resin molded article, and extends in a direction in parallel to a rotation shaft of carrying roller 41 and the rotation shafts of the agitation bar 16 and agitation bar 17. One end as a fixed end of the backflow prevention member 42 is fixed on a holder of the first restriction blade 13 by a screw 45. A front edge part 42*a* as a free end of the backflow prevention member 42 is formed in an R shape, and has a curvature radius R of 0.2 mm. A direction from the fixed end to the free end is a counter (opposite) direction from a rotational direction of the carrying roller 41. The front edge part 42*a* is arranged to abut on an outer circumferential surface of the carrying roller 41. The front edge part 42*a* is formed in the R shape to prevent attrition of the carrying roller 41.

In addition, one part of the bottom surface 22*a* of the frame 22 of the development unit 61 is formed as a guide part 43 that curves along the outer circumferential surface of the carrying roller 41 so that a gap of approximately 1 mm is formed between the bottom surface 22*a* and the carrying roller 41 below the carrying roller 41. The opening part 27 is formed between a top part 43*a* of the guide part 43 and the front edge part 42*a* as the free end of the backflow prevention member 42. The opening part 27 causes the first toner containing part 21*a* to communicate with the second toner containing part 21*b*, and the toner passes through the opening part 27.

The agitation bar 16 as the second rotational member is arranged on the second toner containing part 21*b* side of the opening part 27. Furthermore, the agitation bar 17 is arranged between the agitation bar 16 and the subsidiary supply roller 14.

More specifically described, as shown in FIG. 7B, a projection part 43*b* is formed between a first surface 22*a*1 and a second surface 22*a*2. The projection part 43*b* is formed projecting toward the backflow prevention member 42. The top part 43*a* is formed at the leading edge of the projection part 43*b*. In a region between a center 41*a* of the carrying roller 41 and the top part 43*a* with respect to the toner carrying direction, the guide part 43 is formed along from the first surface 22*a*1 to the top part 43*a*. In other words, the guide part 43 is formed along a rotational outer surface of the carrying roller 41.

The rotation shafts of the carrying roller 41, the agitation bar 16 and the agitation bar 17 are arranged in parallel to each other. The agitation bar 16 and the agitation bar 17, respectively, rotate in directions indicated by arrows in FIGS. 6 and 7 by a driving power from the subsidiary supply roller 14.

In the present embodiment, the backflow prevention member 42 preferably contacts, or slightly presses the outer circumferential surface of the carrying roller 41 to scrape the toner off the carrying roller 41 and to prevent the backflow of the toner.

In addition, the rotational direction of the carrying roller 41 is not limited to the direction indicated by the arrow in FIGS. 6 and 7. However, the backflow prevention member 42 contacts the outer circumferential surface of the carrying roller 41 in a counter direction from the rotation of the backflow prevention member 42 from below, and the guide part 43 is arranged in one part of the frame 22 on the opposite side across the carrying roller 41 when the rotational direction of the carrying roller 41 is opposite from the direction.

A function of the configurations discussed above is explained with reference to FIGS. 6 and 7. Since an operation for image formation that the image forming apparatus 1 performs is the same as the first embodiment, duplicative explanations on the operation are omitted.

In a step of the image formation, in order to collect the development residual toner that has remained on the surface of the development roller 8 without moving to the photosensitive drum 51 during the development, the collection roller 11 is connected to ground through the resistance so that a collection voltage whose polarity is opposite to the charge polarity of the toner is applied to the collection roller 11, and the development residual toner moves onto the collection roller 11, and is scraped off the collection roller 11 by the collection blade 12.

The development residual toner that has been scraped off and has fallen from the collection roller 11 into the first toner containing part 21*a* by the collection blade 12 is carried in the rotational direction indicated by the arrow of the carrying roller 41 in FIGS. 6 and 7 by concave and convex parts on the surface of the carrying roller 41. When the carried toner passes through the opening part 27 and reaches the position of the backflow prevention member 42, the carried toner is scraped off the carrying roller 41 by the backflow prevention member 42 and moves to the second toner containing part 21*b* side since the backflow prevention member 42 contacts the carrying roller 41.

The toner that has moved to the second toner containing part 21*b* is agitated by the agitation bar 16. One part of the toner moves in a direction of the agitation bar 17, is mixed into toner provided from the toner cartridge 19, and is reused.

In addition, since the carrying roller 41 contacts the backflow prevention member 42, and a gap between the carrying roller 41 and the guide part 43 is small, almost all the toner does not move in a direction from the agitation bar 16 to the carrying roller 41. Accordingly, the toner in the first toner containing part 21*a* effectively moves to the second toner containing part 21*b*.

As explained above, in the second embodiment, the carrying roller that rotate and the backflow prevention member that restricts the backflow of the toner are provided. The toner collected by the collection roller moves from the first toner containing part that retains the collection toner to the second toner containing part side that retains unused toner. The collected toner does not accumulate in the vicinity of the development roller. Accordingly, an effect that the quality of the image of the developer image is improved is obtained.

In addition, an effect that the collected toner is efficiently reused is obtained.

The first and second embodiments are explained with a printer as an image forming apparatus. However, the image forming apparatus is not limited thereto, but may be a photocopy apparatus, a facsimile device, and a multi function peripherals (MFP) that includes the photocopy apparatus and the facsimile device.

What is claimed is:

1. A developer carrying device, comprising:

a developer carrier configured to carry developer;

a developer supply member arranged in facing relation to the developer carrier, and configured to supply the developer to the developer carrier;

a developer collection member arranged in facing relation to the developer carrier and configured to collect the developer from the developer carrier;

a first developer containing part configured to contain developer;

a first rotational member arranged in the first developer containing part;

a second developer containing part arranged side by side with the first developer containing part;

a second rotational member arranged in the second developer containing part;

an opening part formed between the first developer containing part and the second developer containing part; and a restriction part arranged between the first rotational member and the second rotational member, wherein the developer supply member is arranged adjacent to the second developer containing part, the developer collection member is arranged adjacent to the first developer containing part, the restriction part is arranged between the first developer containing part and the second developer containing part, and an edge side of the restriction part is formed in the opening part, and the other edge side of the restriction part is arranged in contact with the developer supply member.

2. The developer carrying device of claim 1, wherein the restriction part restricts a movement of developer from the second developer containing part to the first developer containing part.

3. The developer carrying device of claim 1, wherein the first rotational member and the second rotational member rotate in the same direction, the restriction part is arranged at a position that faces a region in which the second rotational member rotates from the second developer containing part toward the first developer containing part, the opening part is arranged at another position that faces a region in which the first rotational member rotates from the first developer containing part toward the second developer containing part.

4. The developer carrying device of claim 1, wherein the first rotational member is a rod-shaped member bended in a crank shape, and the second rotational member is a rod-shaped member bended in a crank shape.

5. The developer carrying device of claim 1, wherein the first rotational member is a roller member.

6. The developer carrying device of claim 5, wherein the second rotational member is a rod-shaped member bended in a crank shape.

7. An image forming apparatus, comprising:

a developer carrying device of claim 1.

8. An image forming apparatus, comprising:

a development device of claim 1.

9. The developer carrying device in accordance with claim 1, wherein the first rotational member is arranged in facing relation to the second rotational member across the opening part.

10. The developer carrying device in accordance with claim 1, further comprising:

a collection blade arranged in contact with the developer collection member.

11. The developer carrying device in accordance with claim 10, wherein each part of the developer collection member, the restriction part, and the collection blade is formed as part of the first developer containing part, and each part of the developer supply member and the restriction part is formed as part of the second developer containing part.

12. A developer carrying device, comprising:

a first developer containing part configured to contain developer;

a first rotational member arranged in the first developer containing part;

a second developer containing part arranged side by side with the first developer containing part;

a second rotational member arranged in the second developer containing part;

an opening part formed between the first developer containing part and the second developer containing part; and a restriction part arranged between the first rotational member and the second rotational member, wherein the restriction part includes one end as a free end and another end as a fixed end that is arranged on an opposite side of the free end, the fixed end is fixed on the first developer containing part, the free end forms the opening part, and the free end is arranged in the vicinity of an imaginary linkage line (Lb) that is formed by linking a rotation center of the first rotational member to a rotation center of the second rotational member.

13. The developer carrying device of claim 12, wherein the free end is arranged on the second rotational member side and the fixed end is arranged on the first rotational member side, and the restriction part is attached in an inclined manner with respect to the imaginary linkage line (Lb).

14. The developer carrying device of claim 12, wherein a rotation shaft of the first rotational member is arranged in substantially parallel to a rotation shaft of the second rotational member, the restriction part is formed of a film member that extends in a direction substantially parallel to the rotation shafts.

15. An image forming apparatus, comprising a developer carrying device of claim 12.

16. A developer carrying device, comprising:

a first developer containing part configured to contain developer;

a first rotational member arranged in the first developer containing part;

a second developer containing part arranged side by side with the first developer containing part;

a second rotational member arranged in the second developer containing part;

an opening part formed between the first developer containing part and the second developer containing part; and a restriction part arranged between the first rotational member and the second rotational member, wherein the first rotational member is a roller member, the restriction part includes one end as a free end and another end as a fixed end that is arranged on an opposite side of the free end, and the fixed end is fixed on the first developer containing part, the free end abuts on an outer circumference of the roller member.

17. The developer carrying device of claim 16, wherein a guide part is formed on one surface of the first containing part, which curves along a rotational outer circumference of the first rotational member such that a gap is formed between the one surface of the first containing part and the rotational outer circumference of the first rotational member, a top part of the guide part is determined as a part where the gap is end in the rotation direction of the first rotational member, an opening part is formed between the top part of the guide part and the free end of the restriction part.

18. The developer carrying device of claim 16, wherein a rotation shaft of the first rotational member is arranged in substantially parallel to a rotation shaft of the second rotational member, the restriction part is a blade shaped member that extends in a direction substantially parallel to the rotation shafts.

19. An image forming apparatus, comprising a developer carrying device of claim 16.

* * * * *